US011335482B2

(12) United States Patent
Liu et al.

(10) Patent No.: US 11,335,482 B2
(45) Date of Patent: May 17, 2022

(54) HIGH-TEMPERATURE-STABILITY PERMANENT MAGNET MATERIAL AND APPLICATION THEREOF

(71) Applicant: NINGBO INSTITUTE OF MATERIALS TECHNOLOGY AND ENGINEERING, CHINESE ACADEMY OF SCIENCES, Ningbo (CN)

(72) Inventors: Lei Liu, Ningbo (CN); Zhuang Liu, Ningbo (CN); Aru Yan, Ningbo (CN); Xin Zhang, Ningbo (CN); Yingli Sun, Ningbo (CN); Dong Li, Ningbo (CN)

(73) Assignee: NINGBO INSTITUTE OF MATERIALS TECHNOLOGY AND ENGINEERING, CHINESE ACADEMY OF SCIENCES, Ningbo (CN)

( * ) Notice: Subject to any disclaimer, the term of this patent is extended or adjusted under 35 U.S.C. 154(b) by 259 days.

(21) Appl. No.: 16/562,438

(22) Filed: Sep. 6, 2019

(65) Prior Publication Data

US 2020/0005974 A1 Jan. 2, 2020

Related U.S. Application Data

(63) Continuation of application No. PCT/CN2018/086056, filed on May 8, 2018.

(51) Int. Cl.
*H01F 1/055* (2006.01)
*H01F 7/02* (2006.01)

(52) U.S. Cl.
CPC ..... *H01F 1/0557* (2013.01); *H01F 7/021* (2013.01)

(58) Field of Classification Search
None
See application file for complete search history.

(56) References Cited

U.S. PATENT DOCUMENTS 4,263,044 A 4/1981 inoue
5,772,796 A 6/1998 Kim

FOREIGN PATENT DOCUMENTS

CN 102403082 Y 4/2012
CN 104183349 A 12/2014
(Continued)

OTHER PUBLICATIONS

Machine translation of CN 104183349A. (Year: 2014).*
(Continued)

*Primary Examiner* — Xiaowei Su

(57) ABSTRACT

The present disclosure discloses a high-temperature-stability permanent magnet material and an application thereof. The microstructure of the permanent magnet material comprises a first magnetic phase and a second magnetic phase; the first magnetic phase is a magnetic phase with uniaxial anisotropy, and the second magnetic phase is a magnetic phase with spin reorientation transition; and the first magnetic phase and the second magnetic phase are isolated from each other; and the absolute value of the temperature coefficient of saturation magnetization intensity of the first magnetic phase is less than 0.02%/° C. By means of the permanent magnet material comprising the first magnetic phase and the second magnetic phase, a positive temperature coefficient of coercivity can be obtained, so that obtaining a low temperature coefficient of coercivity can be targeted, regular and universal.

11 Claims, 6 Drawing Sheets

(56) References Cited

FOREIGN PATENT DOCUMENTS

| | | |
|---|---|---|
| CN | 105655074 Y | 6/2016 |
| CN | 107123497 | 9/2017 |

OTHER PUBLICATIONS

Zou, Lianlong et al, "The Characteristics and Application of Sm2Co17 High Temperature Permanent Magnets, Materials Science and Engineering of Powder Metallurgy", vol. 3(01), Mar. 31, 1998, p. 42, penultimate paragraph.

Liu, L. et al, "Positive Temperature Coefficient of Coercivity in SmLxDyx(CoO.695FeO.2CuO.08ZrO.025)7.2 Magnets with Spin-Reorientation-Transition Cell Boundary Phases", Applied Physics Letters, Feb. 9, 2015 (Feb. 9, 2015), p. 1, left-hand column, paragraph 1 to p. 4, right-hand column, paragraph 2.

* cited by examiner

HIGH-TEMPERATURE-STABILITY PERMANENT MAGNET MATERIAL AND APPLICATION THEREOF

CROSS-REFERENCE TO RELATED APPLICATIONS

This application is a continuation of PCT/CN2018/086056, filed on May 8, 2018, which claims all benefits accruing under 35 U.S.C. § 119 from China Patent Application Nos. 201710243774.0, filed on Apr. 14, 2017, in the China National Intellectual Property Administration, the content of which is hereby incorporated by reference.

TECHNICAL FIELD

This disclosure relates to magnetic materials field, and especially to a high-temperature-stability permanent magnet material and an application thereof.

BACKGROUND

Permanent magnet material is widely used in the fields of electric appliances, automobiles, microwave communication, and aerospace and aviation. New requirements continuously arise for permanent magnet materials in practical requirement. For example, when the inertial instruments, the traveling wave tubes, the sensors, and other special devices are operating in a different environment, the weak fluctuation of the permanent magnet material caused by the temperature change would directly affect the precision of the instruments including the permanent magnet material, causing incalculable risks to the aerospace, aviation, and national defense. Thus, the permanent magnet material with higher temperature stability is desirable.

Currently, the Aluminum-Nickel-Cobalt based magnet or the Samarium-Cobalt based magnet with low temperature coefficient of remanence are used in the inertial instruments, the traveling wave tubes, the sensors, and other special devices. The temperature coefficient of remanence of the Aluminum-Nickel-Cobalt based magnet is about −0.02% per degree centigrade (%/° C.), and the temperature coefficient of coercivity of the Aluminum-Nickel-Cobalt based magnet is about −0.03% per degree centigrade, but the Aluminum-Nickel-Cobalt based magnet is disturbed easily by the vibration, the magnetic field, the radiation, and other factors because of the low coercivity (which is less than 2 kOe) and low magnetic energy product (which is about 10 MGOe). Thus, the Aluminum-Nickel-Cobalt based magnet cannot meet the long-term operation of the special devices. The Samarium-Cobalt based magnet with low temperature coefficient of remanence has a high coercivity (which is greater than 15 kOe), a high magnetic energy product (which is greater than 15 MGOe), and a low absolute value of the temperature coefficient of remanence (which is less than 0.01% per degree centigrade), but the temperature coefficient of coercivity of the Samarium-Cobalt based magnet with low temperature coefficient of remanence is high (which is about −0.3% per degree centigrade), which causes a large difference between the irreversible magnetic loss and the reversible magnetic loss of the magnet at different temperature and affects the long-term operation of the instrument. There is an urgent need to develop magnets with higher temperature stability.

Usually, the inertial instruments, the traveling wave tubes, the sensors, and the other special devices operate in a temperature interval from −40° C. to 100° C. Thus, there is an urgent need to develop magnets with higher temperature stability in the corresponding temperature interval. Based on the conventional Samarium-Cobalt based magnet with low temperature coefficient of remanence, the permanent magnet material with positive temperature coefficient, and the application thereof (which is disclosed in Chinese Patent application with application number 201410663449.6), this disclosure provides a new high-temperature-stability magnet which can have the improved coercivity temperature stability other than the high magnetic energy product and the low absolute value of the temperature coefficient of remanence of the Samarium-Cobalt based magnet with low temperature coefficient of remanence.

SUMMARY

This disclosure provides a high-temperature-stability permanent magnet material and an application thereof. The permanent magnet material has a relative higher high-temperature-stability in a certain temperature range.

The high-temperature-stability permanent magnet material can comprise a permanent magnet having a microstructure, wherein the microstructure comprises: a strong magnetic phase and a magnetic phase with spin reorientation transition; the strong magnetic phase and the magnetic phase with spin reorientation transition are isolated from each other; and a first absolute value of a temperature coefficient of saturation magnetization intensity of the strong magnetic phase is less than 0.02%/° C.

In one embodiment, a size of the microstructure in at least one dimension is in a range from about 5 nanometers to about 800 nanometers.

In one embodiment, the strong magnetic phase and the magnetic phase with spin reorientation transition are isolated from each other by encapsulation, interlayer, or both encapsulation and interlayer.

In one embodiment, an easy magnetization direction of the magnetic phase with spin reorientation transition has a convention from easy plane to easy axis as temperature increases.

In one embodiment, the strong magnetic phase is a SmCo compound, and the Sm is partially replaced by HRE or by a combination of HRE and R different from HRE. The magnetic phase with spin reorientation transition is a $RCo_5$ compound, a derivative compound of the $RCo_5$ compound, a $R_2Co_{17}$ compound, or a derivative compound of the $R_2Co_{17}$ compound.

HRE can be selected from the group consisting essentially of Gd, Tb, Dy, Ho, Er, Tm, Yb, Lu, and a combination thereof.

R can be selected from the group consisting essentially of Pr, Nd, Dy, Tb, Ho, and a combination thereof.

In one embodiment, the permanent magnet is a Samarium-Cobalt based permanent magnet consisting essentially of Sm, Co, HRE, R, and M;

in the Samarium-Cobalt based permanent magnet, the strong magnetic phase is a $(SmHRER)_2(CoM)_{17}$ compound, and the magnetic phase with spin reorientation transition is a $(SmHRER)(CoM)_5$ compound; in the microstructure of the Samarium-Cobalt based permanent magnet, the $(SmHRER)(CoM)_5$ compound encapsulates the $(SmHRER)_2(CoM)_{17}$ compound;

HRE is selected from the group consisting essentially of Gd, Tb, Dy, Ho, Er, Tm, Yb, Lu, and a combination thereof; R is selected from the group consisting essentially of Pr, Nd, Dy, Tb, Ho, and a combination thereof; M is selected from the group consisting essentially of Fe, Cu, Zr, Ni, Ti, Nb, Mo, Hf, W, and a combination thereof; and the SmHRER comprises at least three elements.

In one embodiment, in the Samarium-Cobalt based permanent magnet, a percentage of mass of R is from 8% to 20%, and a percentage of mass of HRE is 8 from 8% to 18%; and Tb and/or Ho of HRE is also used as R and used for calculating the percentage of mass of R when HRE comprises Dy, Tb, Ho, or combination thereof.

In one embodiment, as the percentage of mass of R increases, a spin reorientation transition temperature of the $(SmHRER)(CoM)_5$ compound increases, the maximum coercivity and the minimum coercivity of the $(SmHRER)(CoM)_5$ compound shifts toward a higher temperature range, and a first temperature interval where a second absolute value of a temperature coefficient of coercivity of the $(SmHRER)(CoM)_5$ compound is less than 0.03% per degree centigrade also shifts toward the higher temperature range.

In one embodiment, as the percentage of mass of HRE increases, a second temperature interval where the first absolute value of the temperature coefficient of saturation magnetization intensity of the $(SmHRER)_2(CoM)_{17}$ compound is less than 0.02%/° C. shifts toward a higher temperature range.

In one embodiment, in a temperature range from 2K to 600K, a second absolute value of a temperature coefficient of coercivity of the permanent magnet is less than 0.03% per degree centigrade, and a third absolute value of a temperature coefficient of remanence of the permanent magnet is less than 0.02% per degree centigrade.

Furthermore, a device comprising the high-temperature-stability permanent magnet material above is provided. At least one element of the device is made of or comprises the high-temperature-stability permanent magnet material above is provided.

By means of the permanent magnet material comprising the strong magnetic phase and the magnetic phase with spin reorientation transition, a positive temperature coefficient of coercivity can be obtained, so that obtaining a low temperature coefficient of coercivity can be targeted, regular and universal. Moreover, a temperature coefficient of remanence of the magnet can be adjusted based on the anti-ferromagnetism coupling characteristic of the heavy rare earth elements and transitional metals. In addition, the temperature interval of the low temperature coefficient of coercivity and the temperature interval of the low temperature coefficient of remanence of the permanent magnet material are adjusted by adjusting components and process for making the permanent magnet material, so as to meet the application requirements of the permanent magnet material in different fields.

DETAILED DESCRIPTION

Figure 1A:
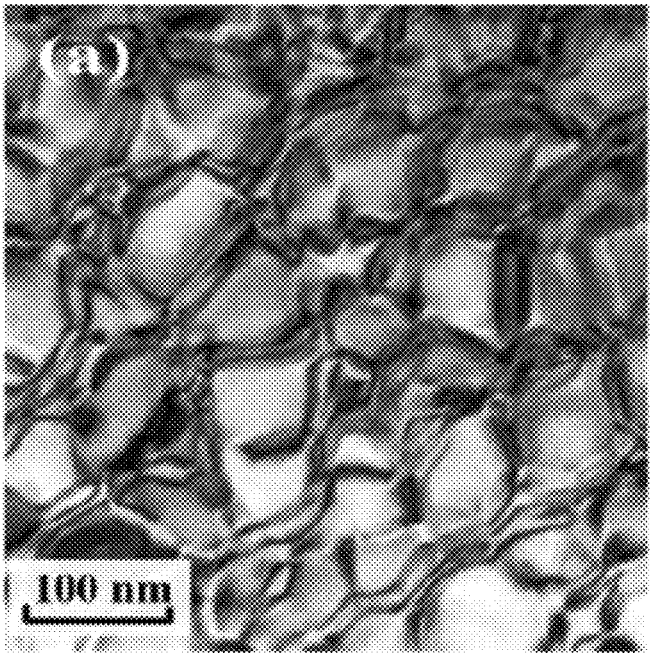
FIG. 1A shows a transmission electron microscope (TEM) photo of the Samarium-Cobalt based permanent magnet obtained in embodiment 4 when the observation plane is perpendicular to the orientation axis.

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

The term "comprising" means "including, but not necessarily limited to"; it specifically indicates open-ended inclusion or membership in a so-described combination, group, series and the like. It should be noted that references to "an" or "one" embodiment in this disclosure are not necessarily to the same embodiment, and such references mean at least one.

Unless otherwise defined, all technical and scientific terms used herein have the same meaning as a skilled person in the art would understand. The terminology used in the description of the present disclosure is for the purpose of describing particular embodiments and is not intended to limit the disclosure.

A common method to obtain a magnet with a low temperature coefficient of remanence is using an anti-ferromagnetism coupling mechanism or external compensating sheets. However, the low temperature coefficient of coercivity and the low temperature coefficient of remanence usually cannot be simultaneously achieved by a certain method. However, the general technology application requires the permanent magnet material with both the temperature coefficient of remanence and the temperature coefficient of coercivity as low as possible. The conventional technology cannot meet the practical requirement.

The temperature coefficient of remanence satisfies the formula:

$$\alpha(T_0-T_1)=\{[B_r(T_0)-B_r(T_1)]/[B_r(T_0)\times(T_0-T_1)]\}\times 100\%.$$

In above formula, $B_r(T_0)$ is the remanence value at temperature $T_0$, and $B_r(T_1)$ is the remanence value at temperature $T_1$.

The temperature coefficient of coercivity satisfies the formula:

$$\beta(T_0-T_1)=\{[H_{cj}(T_0)-H_{cj}(T_1)]/[H_{cj}(T_0)\times(T_0-T_1)]\}\times 100\%.$$

In above formula, $H_{cj}$ $(T_0)$ is the coercivity value at temperature $T_0$, and $H_{cj}(T_1)$ is the coercivity value at temperature $T_1$.

Through experimentation, it was found that the maximum coercivity and the minimum coercivity appear at a temperature near the spin reorientation transition temperature of the magnetic phase with spin reorientation transition. Thus, the absolute value of the temperature coefficient of coercivity is much lower at the temperature interval near the maximum and the minimum coercivity. The term "magnetic phase with spin reorientation transition" means that the easy magnetization axis of some magnetic alloy phase would change as the change of temperature. The change of the easy magnetization axis includes the convention of the easy magnetization axis such as a convention from easy axis to easy plane or a convention from easy plane to easy axis, where the spin reorientation happens. The temperature where the convention of the easy magnetization axis happens is the temperature where the spin reorientation happens, namely spin reorientation transition temperature. The temperature interval near the maximum and the minimum coercivity is the temperature interval of low temperature coefficient of coercivity.

According to above principle, a high-temperature-stability permanent magnet material is provided in this disclosure. The microstructure of the high-temperature-stability permanent magnet material includes a strong magnetic phase and a magnetic phase with spin reorientation transition, the strong magnetic phase and the magnetic phase with spin reorientation transition are isolated from each other, and the absolute value of the temperature coefficient of saturation magnetization intensity of the strong magnetic phase is less than 0.02%/° C. In one embodiment, the size of the microstructure in at least one dimension, such as length or width, can be in a range from about 5 nanometers (nm) to about 800 nanometers.

In one embodiment, the absolute value of the temperature coefficient of saturation magnetization intensity of the strong magnetic phase is less than 0.01%/° C.

It should be noted that the term "strong magnetic phase" of this disclosure is the magnetic phase with uniaxial anisotropy.

In the permanent magnet material of this disclosure, the magnetic phase with spin reorientation transition can be a $RCo_5$ compound, a derivative compound of the $RCo_5$ compound, a $R_2Co_{17}$ compound, or a derivative compound of the $R_2Co_{17}$ compound, in which R is one or more than one selected from the elements Pr, Nd, Dy, Tb, and Ho. The term "derivative compound" means one element or more than one elements of the alloy are partially replaced by other elements. In one embodiment, R can be partially replaced by Sm or by the combination of Sm and HRE, Co can be partially replaced by M. HRE is one or more than one selected from the elements Gd, Tb, Dy, Ho, Er, Tm, Yb, and Lu. M is one or more than one selected from the elements Fe, Cu, Zr, Ni, Ti, Nb, Mo, Hf, and W. For example, $Sm_{1-x}Dy_xCo_5$ ($0<x<1$) is the derivative compound of $RCo_5$.

In the permanent magnet material of this disclosure, the strong magnetic phase usually can be a SmCo compound, where Sm is partially replaced by HRE or by the combination of HRE and other elements such as the elements of R different from the elements of HRE. In one embodiment, the strong magnetic phase is the SmCo compound obtained by partially replacing Sm of $Sm_2Co_{17}$, $SmCo_5$, or $SmCo_7$ with HRE and R. In one embodiment, Co can also be partially replaced by M. In one embodiment, the elements of R and the elements of HRE of the strong magnetic phase are different, namely, Sm of the SmCo compound is replaced by at least two elements selected from HRE and R, so that the strong magnetic phase with components of at least three elements is obtained.

The R, M and HRE of the strong magnetic phase and the R, M and HRE of the magnetic phase with spin reorientation transition can be the same or different. In one embodiment, R of the strong magnetic phase is the same as R of the magnetic phase with spin reorientation transition, M of the strong magnetic phase is the same as M of the magnetic phase with spin reorientation transition, and HRE of the strong magnetic phase is also the same as HRE of the magnetic phase with spin reorientation transition. In general, when the magnetic phases with spin reorientation transition are different, the spin reorientation transition temperatures are also different. For example, the easy magnetization direction of $DyCo_5$ alloy has a convention from easy plane to easy axis at 370K, and the spin reorientation transition temperature of $DyCo_5$ alloy is 370K; the easy magnetization direction of $TbCo_5$ alloy changes from easy plane to easy axis at 410K, and the spin reorientation transition temperature of $TbCo_5$ alloy is 410K. Thus, the spin reorientation transition temperature can be obtained by selecting the magnetic phase with spin reorientation transition, so that the temperature interval of the low temperature coefficient of coercivity can be obtained. Through experimentation, it was found that the temperature interval of the low temperature coefficient of remanence shifts toward a higher temperature range as the content of heavy rare earth elements HRE increases. Thus, the temperature interval of the low temperature coefficient of remanence can be obtained by adjusting the content of heavy rare earth elements.

In one embodiment, the high-temperature-stability permanent magnet material of this disclosure has both low temperature coefficient of coercivity and low temperature coefficient of remanence in the temperature of 10K to 600K. The absolute value of the low temperature coefficient of coercivity can be less than 0.3% per degree centigrade, or even less than 0.03% per degree centigrade. The absolute value of the low temperature coefficient of remanence can be less than 0.03% per degree centigrade, or even less than 0.02% per degree centigrade. Because permanent magnet materials are mainly applied in fields such as electronics and electrical appliances, motor vehicle, microwave communications, and inertial instruments, the low temperature coefficient of coercivity and the low temperature coefficient of remanence of the permanent magnet material can be adjusted by adjusting components and process for making the permanent magnet material, so as to meet the application requirements of the permanent magnet material in different fields.

The permanent magnet material can have better magnetic properties and higher practical application value since both low temperature coefficient of coercivity and low temperature coefficient of remanence can be obtained in the temperature of 100K to 600K.

In the high-temperature-stability permanent magnet material of this disclosure, the strong magnetic phase and the magnetic phase with spin reorientation transition can be isolated from each other by encapsulation, interlayer, or both encapsulation and interlayer. For example, the magnetic phase with spin reorientation transition encapsulates the strong magnetic phase, the strong magnetic phase encapsulates the magnetic phase with spin reorientation transition, or the strong magnetic phase and the magnetic phase with spin reorientation transition are alternately stacked with each other layer by layer. The isolation manner between the strong magnetic phase and the magnetic phase with spin reorientation transition depends on the methods for making the high-temperature-stability permanent magnet material. In order to obtain the isolation structure between the strong magnetic phase and the magnetic phase with spin reorientation transition, the methods for making the high-temperature-stability permanent magnet material of this disclosure can be powder metallurgy, sputtering, electroplating, or diffusion. The high-temperature-stability permanent magnet material made by the methods of sputtering or diffusion usually has the interlayer isolation manner, and the high-temperature-stability permanent magnet material made by the methods of powder metallurgy or electroplating usually has the encapsulation isolation manner.

In one embodiment, the high-temperature-stability permanent magnet material of this disclosure is a Samarium-Cobalt based permanent magnet. The Samarium-Cobalt based permanent magnet consists of elements Sm, Co, HRE, R, and M. HRE is one or more than one selected from the elements Gd, Tb, Dy, Ho, Er, Tm, Yb, and Lu. R is one or more than one selected from the elements Pr, Nd, Dy, Tb, and Ho. M is one or more than one selected from the elements Fe, Cu, Zr, Ni, Ti, Nb, Mo, Hf, and W. The SmHRER includes at least three elements. Furthermore, in the Samarium-Cobalt based permanent magnet, the strong magnetic phase is a $(SmHRER)_2(CoM)_{17}$ compound, and the magnetic phase with spin reorientation transition is a $(SmHRER)(CoM)_5$ compound. The $(SmHRER)(CoM)_5$ compound can encapsulate the $(SmHRER)_2(CoM)_{17}$ compound, and the $(SmHRER)(CoM)_5$ compound can be regarded as a cell boundary phase and the $(SmHRER)_2(CoM)_{17}$ compound can be regarded as a intracellular phase. It can be understood that each of the $(SmHRER)_2(CoM)_{17}$ compound and the $(SmHRER)(CoM)_5$ compound is a series of compound including the elements Sm, Co, HRE, R, and M, but the ratio of Sm, HRE and R is not limited as 1:1:1, and the ratio of Co and M is not limited as 1:1.

Both HRE and R can include Dy, Tb, Ho, or combination thereof. The content of Dy, Tb, and Ho in R and the content of Dy, Tb, and Ho in HRE are calculated repeatedly, that is, when HRE includes Dy, Tb, Ho, or combination thereof, the Dy, Tb and/or Ho of HRE would also be used as the elements of R and used for calculating the percentage of mass of R.

For example, when HRE includes Dy, Tb, Ho, or combination thereof, the percentage of mass of R is the sum of the percentage of mass of Dy, Tb and/or Ho and the percentage of mass of other elements of R different from Dy, Tb and Ho. It should be noted that the Samarium-Cobalt based permanent magnet of this disclosure cannot be equated with the conventional Samarium-Cobalt based permanent magnet in prior art because the $(SmHRER)(CoM)_5$ compound of the Samarium-Cobalt based permanent magnet of this disclosure has the magnetic phase with spin reorientation transition.

In order to obtain both low temperature coefficient of coercivity and low temperature coefficient of remanence, in the Samarium-Cobalt based permanent magnet of this disclosure, the percentage of mass of R is from 8% to 20%, and the percentage of mass of HRE is from 8% to 18%.

In the Samarium-Cobalt based permanent magnet of this disclosure, the spin reorientation transition temperature and the temperature interval of the low temperature coefficient of coercivity of the $(SmHRER)(CoM)_5$ compound with spin reorientation transition can be adjusted by adjusting the elemental type of R or the content of R. When the elemental type of R and/or the content of R is changed, the spin reorientation transition temperature of the $(SmHRER)(CoM)_5$ compound would be changed correspondingly, and the temperature interval of the low temperature coefficient of coercivity of the $(SmHRER)(CoM)_5$ compound would also be changed. In one embodiment, when the percentage of mass of R is from 8% to 20%, as the percentage of mass of R increases, the spin reorientation transition temperature of the $(SmHRER)(CoM)_5$ compound increases, and the temperature interval where the absolute value of the temperature coefficient of coercivity is less than 0.03% per degree centigrade shifts toward higher temperature range. The temperature interval of low temperature coefficient of remanence can be adjusted by adjusting the elemental type of the heavy rare earth element HRE or the content of the heavy rare earth element HRE. In one embodiment, when the percentage of mass of HRE is from 8% to 18%, as the percentage of mass of HRE increases, the temperature interval where the absolute value of the temperature coefficient of saturation magnetization intensity is less than 0.02%/° C. shifts toward higher temperature range, so that the temperature interval of low temperature coefficient of remanence shifts toward higher temperature range.

In one embodiment, because the easy magnetization axis of the magnetic phase with spin reorientation transition would change as the temperature change, the easy magnetization direction of the magnetic phase with spin reorientation transition would have a convention from easy plane to easy axis as the temperature change. Many magnets have the magnetic phase change rule above, such as the Samarium-Cobalt based permanent magnet above.

By means of the permanent magnet material comprising the strong magnetic phase and the magnetic phase with spin reorientation transition, a positive temperature coefficient of coercivity can be obtained in this disclosure, so that obtaining a low temperature coefficient of coercivity can be targeted, regular and universal. Moreover, a temperature coefficient of remanence of the magnet can be adjusted based on the anti-ferromagnetism coupling characteristic of the heavy rare earth elements and transitional metals. In addition, the temperature interval of the low temperature coefficient of coercivity and the temperature interval of the low temperature coefficient of remanence of the permanent magnet material are adjusted by adjusting components and process for making the permanent magnet material.

In the temperature intervals of the low temperature coefficient of coercivity, the permanent magnet material has high temperature stability, that is, the magnetic properties of the permanent magnet material would not decreases as the temperature increases. Thus, the permanent magnet material has higher practical application value. Furthermore, the temperature intervals of the low temperature coefficient of coercivity depends on the spin reorientation transition temperature of the magnetic phase with spin reorientation transition to a certain degree, thus, the temperature intervals of the low temperature coefficient of coercivity can be adjusted by adjusting the spin reorientation transition temperature, so as to meet the application requirements of the permanent magnet material in different fields.

The permanent magnet material of this disclosure has high temperature stability, and the magnetic properties of the permanent magnet material are substantially kept unchanged in a certain temperature interval. Thus, the permanent magnet material has a higher practical application value in variable temperature environment.

In order to better understand the objective, many specific embodiments are provided as following to further describe this disclosure.

Embodiment 1

The Samarium-Cobalt based permanent magnet consisting essentially of elements Sm, Co, Fe, Cu, Zr, Gd, and Dy is made. Percentages of mass of these elements of Sm is about 12.90%, Co is about 50.61%, Fe is about 13.80%, Cu is about 6.28%, Zr is about 2.82%, Gd is about 10.79%, and Dy is about 2.79%. HRE is the combination of Gd and Dy with percentage of mass of about 13.58%, Dy is also the element of R, and the percentage of mass of R is about 2.79%.

The Samarium-Cobalt based permanent magnet can be made by following steps:

S100, providing a raw material including elements Sm, Co, Fe, Cu, Zr, Gd, and Dy in accordance with above percentages of mass;

S200, smelting the raw material in an induction smelting furnace to obtain an alloy ingot; then crushing the alloy ingot to form grains, and jet milling or ball milling the grains to obtain magnet powder;

S300, shaping the magnet powder obtained in step S200 under the protection of nitrogen gas and in a magnetic field with an intensity of about 2 T to form a preform, and then cold isostatic pressing the preform for about 60 seconds under the pressure of about 200 Mpa to obtain a magnet body;

S400, sintering the magnet body obtained in step S300 in a vacuum sintering furnace with an air pressure below 4 mPa and under the protection of argon gas.

In S400, the sintering the magnet body is performed as following: the vacuum sintering furnace is first heated to a temperature from 1200° C. to 1215° C. and kept at this temperature for about 30 minutes for sintering; the vacuum sintering furnace is cooled to a temperature from 1160° C. to 1190° C. and kept at this temperature for about 3 hours for solid solution; the vacuum sintering furnace is cooled to room temperature by air cooling or water cooling; the vacuum sintering furnace is heated to about 830° C. and isothermal aging for about 12 hours at this temperature; the vacuum sintering furnace is cooled to about 400° C. with a cooling speed of about 0.7° C./min and kept at this temperature for about 3 hours; and then the vacuum sintering furnace is rapidly cooled to room temperature, and the Samarium-Cobalt based permanent magnet is obtained.

In embodiment 1, the microstructure of the Samarium-Cobalt based permanent magnet is a cellular structure composed of a $(SmHRER)(CoM)_5$ compound and a $(SmHRER)_2(CoM)_{17}$ compound. The $(SmHRER)(CoM)_5$ compound is a cell boundary phase, the $(SmHRER)_2(CoM)_{17}$ compound is a intracellular phase, the crystalline structure of the $(SmHRER)_2(CoM)_{17}$ compound is a rhombic structure, the crystalline structure of the $(SmHRER)(CoM)_5$ compound is a hexagonal structure, and the Cu element concentrates in the $(SmHRER)(CoM)_5$ compound of the cell boundary phase.

Figure 2:
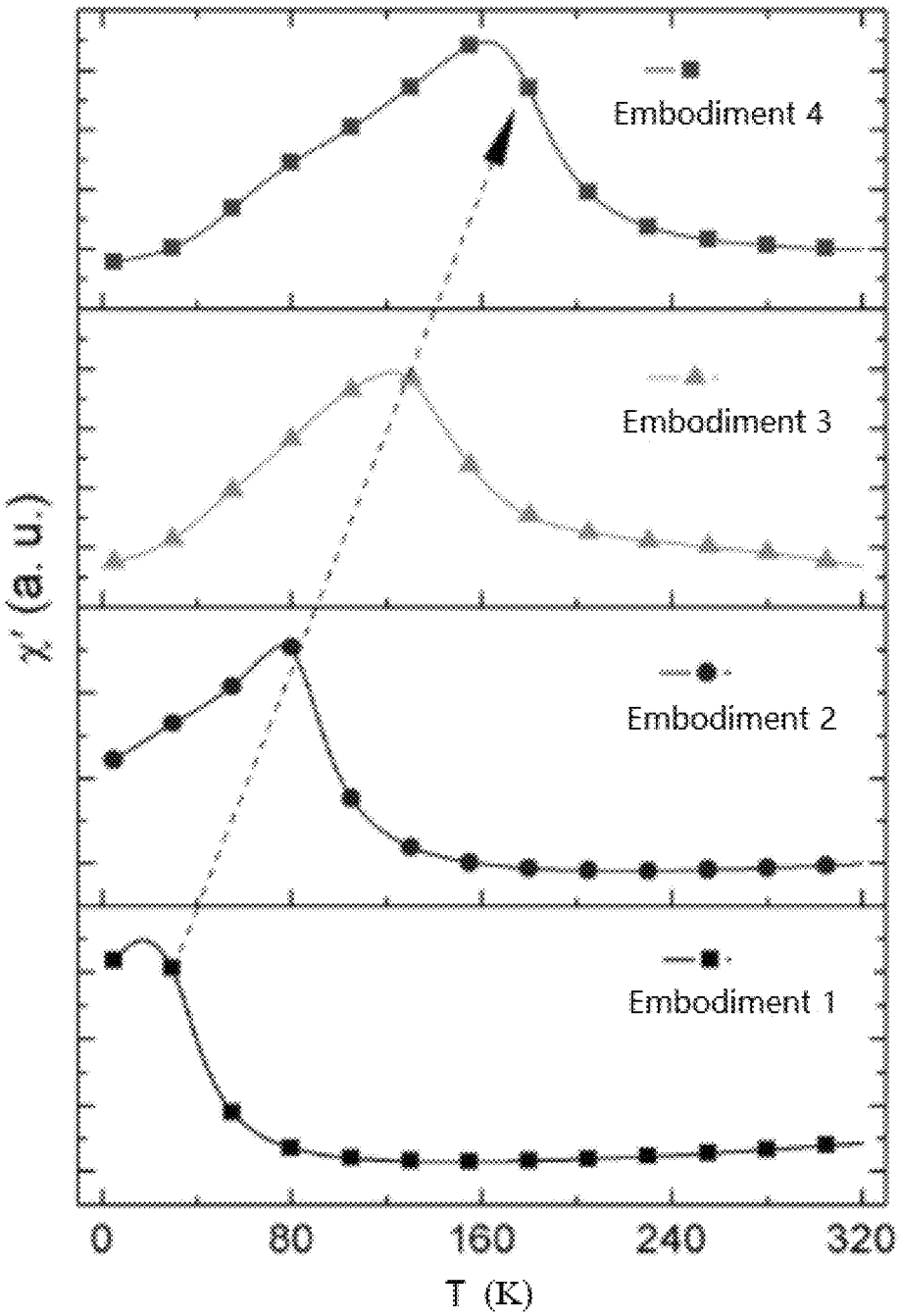
FIG. 2 shows an alternating current (AC) magnetic susceptibility test result of the Samarium-Cobalt based permanent magnets respectively obtained in embodiments 1 through 4, where the test is performed at an alternating current (AC) field of 5 Oe and a frequency of 1000 Hz.
Figure 3:
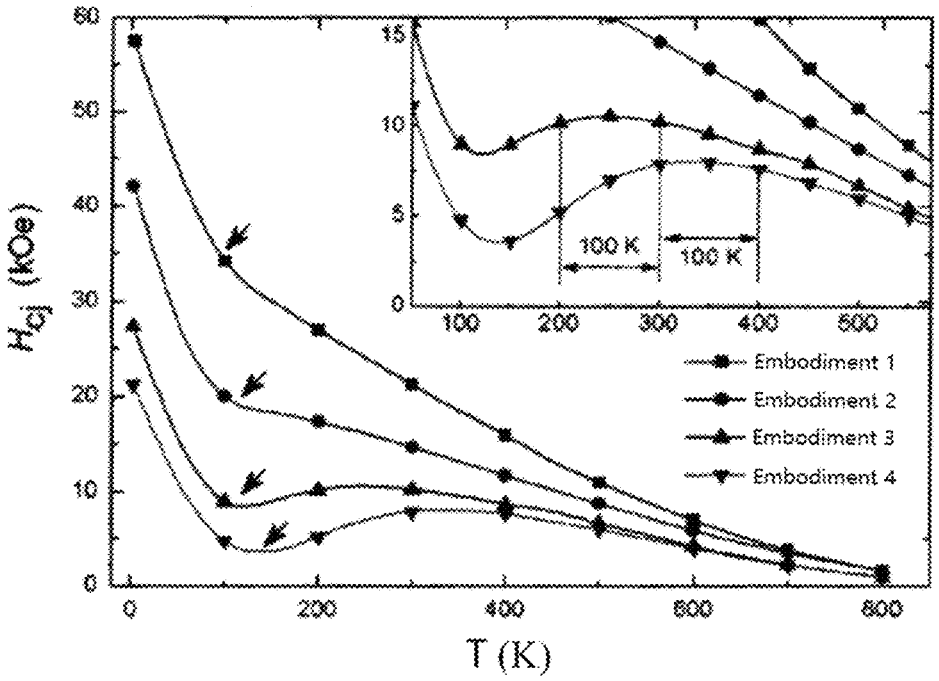
FIG. 3 shows a relationship between the coercivity and the temperature of the Samarium-Cobalt based permanent magnets respectively obtained in embodiments 1 through 4.
Figure 4:
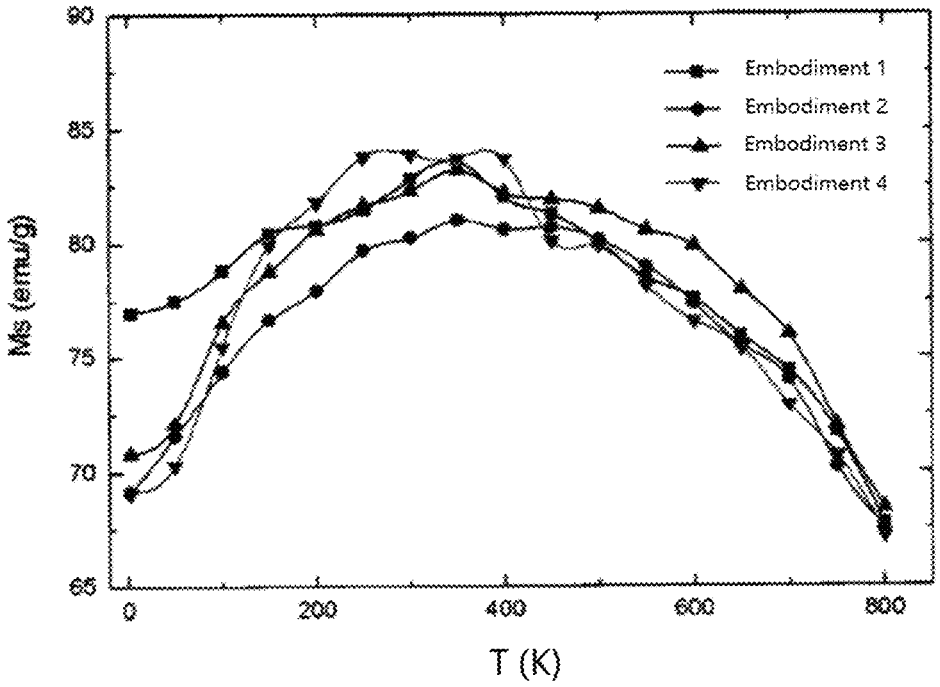
FIG. 4 shows a relationship between the saturation magnetization intensity and the temperature of the Samarium-Cobalt based permanent magnets respectively obtained in embodiments 1 through 4.
Figure 5:
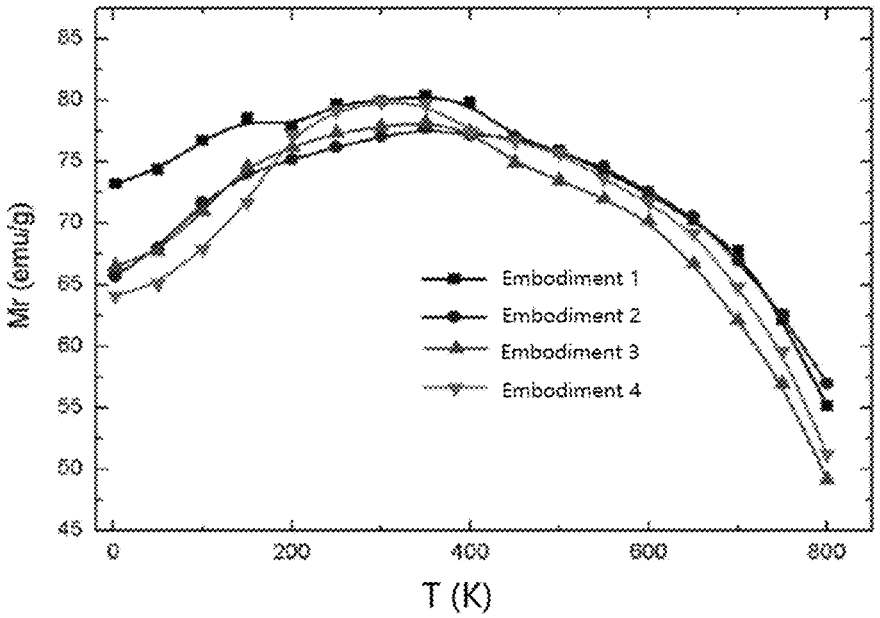
FIG. 5 shows a relationship between the remanence and the temperature of the Samarium-Cobalt based permanent magnets respectively obtained in embodiments 1 through 4.
Figure 6:
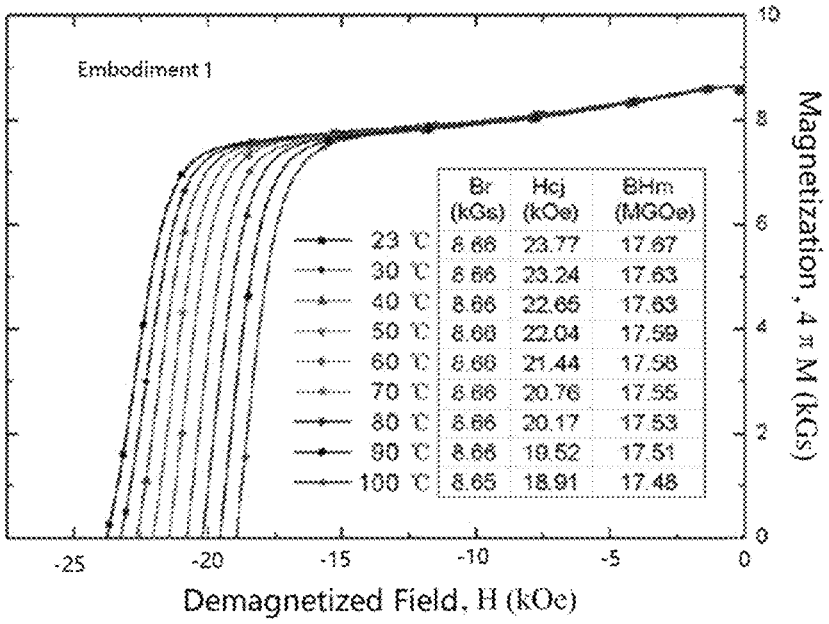
FIG. 6 shows a demagnetization curve from the room temperature to 100° C. of the Samarium-Cobalt based permanent magnet obtained in embodiment 1.

The alternating current magnetic susceptibility test and magnetic properties test are performed on the Samarium-Cobalt based permanent magnet obtained in embodiment 1. FIG. 2 shows the alternating current magnetic susceptibility test result. From FIG. 2, it can be seen that the spin reorientation transition temperature of the $(SmHRER)(CoM)_5$ compound of this sample is about 18K. FIG. 3 shows the relationship between the coercivity and the temperature. From FIG. 3, it can be seen that the coercivity decreases as the temperature increases. FIG. 4 shows the relationship between the saturation magnetization intensity and the temperature. FIG. 5 shows the relationship between the remanence and the temperature. From FIGS. 4 and 5, it can be seen that the saturation magnetization intensity and the remanence have the same variation as the temperature increases, and both the saturation magnetization intensity and the remanence increases first and then decreases as the temperature increases. FIG. 6 shows the demagnetization curve from the room temperature to about 100° C. From FIG. 6, it can be seen that, at the temperature interval from the room temperature to about 100° C., the absolute value of the temperature coefficient of remanence of the magnet is less than 0.01% per degree centigrade, and the temperature coefficient of coercivity is about −0.2655% per degree centigrade. Table 1 shows the saturation magnetization intensity, the remanence, the coercivity of the Samarium-Cobalt based permanent magnet obtained in embodiment 1 at different temperatures. Table 1 also shows the temperature coefficient of saturation magnetization intensity, the temperature coefficient of remanence, and the temperature coefficient of coercivity of the Samarium-Cobalt based permanent magnet obtained in embodiment 1 at corresponding temperature intervals. In following tables, "T" represents temperature, "Ms" represents saturation magnetization intensity, "Mr" represents remanence, "Hcj" represents coercivity, "Ti" represents temperature interval, "γ" represents temperature coefficient of saturation magnetization intensity, "α" represents temperature coefficient of remanence, "β" represents temperature coefficient of coercivity.

TABLE 1

| Number | T (K.) | Ms (emu/g) | Mr (emu/g) | Hcj (Oe) | Ti (K.) | | γ (%/° C.) | α (%/° C.) | β (%/° C.) |
|---|---|---|---|---|---|---|---|---|---|
| Embodiment 1 | 2 | 76.97 | 73.23 | 57557 | start | stop | | | |
| | 50 | 77.5 | 74.42 | 44013 | 2 | 50 | 0. 0143 | 0.0338 | −0.4902 |
| | 100 | 78.81 | 76.71 | 34210 | 50 | 100 | 0.0338 | 0.0615 | −0.4454 |
| | 150 | 80.46 | 78.54 | 30033 | 100 | 150 | 0.0418 | 0.0477 | −0.2442 |
| | 200 | 80.8 | 78.86 | 27013 | 150 | 200 | 0.0084 | 0.0081 | −0.2011 |
| | 250 | 81.5 | 79.72 | 24151 | 200 | 250 | 0.0173 | 0.0218 | −0.2119 |
| | 300 | 82.8 | 80 | 21283 | 250 | 300 | 0.0319 | 0.0070 | −0.2375 |
| | 350 | 83.6 | 80.4 | 18547 | 300 | 350 | 0.0193 | 0.01 | −0.2571 |
| | 400 | 84.8 | 81 | 15959 | 350 | 400 | 0.0287 | 0.01492 | −0.2791 |
| | 450 | 84.28 | 80.95 | 13201 | 400 | 450 | −0.0122 | −0.00123 | −0.3456 |
| | 500 | 84 | 79.89 | 10973 | 450 | 500 | −0.0066 | −0.0261 | −0.3375 |
| | 550 | 82.5 | 78.3 | 8917 | 500 | 550 | −0.0357 | −0.0398 | −0.3747 |
| | 600 | 81.56 | 76.44 | 7005 | 550 | 600 | −0.0228 | −0.0475 | −0.4288 |
| | 650 | 79.93 | 74.25 | 5309 | 600 | 650 | −0.0399 | −0.0572 | −0.4842 |

TABLE 1-continued

| Number | T (K.) | Ms (emu/g) | Mr (emu/g) | Hcj (Oe) | Ti (K.) | | γ (%/° C.) | α (%/° C.) | β (%/° C.) |
|---|---|---|---|---|---|---|---|---|---|
| | 700 | 78.4 | 71.79 | 3844 | 650 | 700 | −0.0382 | −0.0662 | −0.551893 |
| | 750 | 75.7 | 66.15 | 2681 | 700 | 750 | −0.0689 | −0.1571 | −0.60519 |
| | 800 | 71.7 | 59.16 | 1723 | 750 | 800 | −0.1057 | −0.2113 | −0.7146 |

Embodiment 2

The Samarium-Cobalt based permanent magnet consisting essentially of elements Sm, Co, Fe, Cu, Zr, Gd, and Dy is made. Percentages of mass these elements of Sm is about 12.89%, Co is about 50.57%, Fe is about 13.79%, Cu is about 6.28%, Zr is about 2.82%, Gd is about 8.09%, and Dy is about 5.57%. HRE is the combination of Gd and Dy with percentage of mass of about 13.66%, Dy is also the element of R, and the percentage of mass of R is about 5.57%.

The Samarium-Cobalt based permanent magnet of embodiment 2 can be made by the same method of embodiment 1.

In embodiment 2, the microstructure of the Samarium-Cobalt based permanent magnet is a cellular structure composed of the $(SmHRER)(CoM)_5$ compound and the $(SmHRER)_2(CoM)_{17}$ compound. The $(SmHRER)(CoM)_5$ compound is a cell boundary phase, the $(SmHRER)_2(CoM)_{17}$ compound is an intracellular phase, the crystalline structure of the $(SmHRER)_2(CoM)_{17}$ compound is a rhombic structure, the crystalline structure of the $(SmHRER)(CoM)_5$ compound is a hexagonal structure.

The alternating current magnetic susceptibility test and magnetic properties test are performed on the Samarium-Cobalt based permanent magnet obtained in embodiment 2. FIG. 2 shows the alternating current magnetic susceptibility test result. From FIG. 2, it can be seen that the spin reorientation transition temperature of the $(SmHRER)(CoM)_5$ compound of this sample is about 80K. FIG. 3 shows the relationship between the coercivity and the temperature. From FIG. 3, it can be seen that the coercivity decreases as the temperature increases, and the temperature coefficient of coercivity of embodiment 2 at the temperature interval of 150K to 300K is obviously less than the temperature coefficient of coercivity of embodiment 1 at the temperature interval of 150K to 300K. FIG. 4 shows the relationship between the saturation magnetization intensity and the temperature. FIG. 5 shows the relationship between the remanence and the temperature. From FIGS. 4 and 5, it can be seen that the saturation magnetization intensity and the remanence have the same variation as the temperature increases, both the saturation magnetization intensity and the remanence increases first and then decreases as the temperature increases, and the remanence has very small variation as the temperature change at the temperature interval of 300K to 400K. Table 2 shows the saturation magnetization intensity, the remanence, the coercivity of the Samarium-Cobalt based permanent magnet obtained in embodiment 2 at different temperatures. Table 2 also shows the temperature coefficient of saturation magnetization intensity, the temperature coefficient of remanence, and the temperature coefficient of coercivity of the Samarium-Cobalt based permanent magnet obtained in embodiment 2 at corresponding temperature intervals.

TABLE 2

| Number | T (K.) | Ms (emu/g) | Mr (emu/g) | Hcj (Oe) | Ti (K.) | | γ (%/° C.) | α (%/° C.) | β (%/° C.) |
|---|---|---|---|---|---|---|---|---|---|
| Embodiment 2 | 2 | 69.14 | 65.71 | 42160 | start | stop | | | |
| | 50 | 71.59 | 67.99 | 27908 | 2 | 50 | 0.0738 | 0.0723 | −0.7043 |
| | 100 | 74.4 | 71.7 | 20019 | 50 | 100 | 0.0785 | 0.1091 | −0.5654 |
| | 150 | 76.68 | 74.08 | 18349 | 100 | 150 | 0.0613 | 0.0664 | −0.1668 |
| | 200 | 77.94 | 75.2 | 17339 | 150 | 200 | 0.0329 | 0.0302 | −0.1101 |
| | 250 | 79.7 | 76.22 | 16083 | 200 | 250 | 0.0452 | 0.0271 | −0.1449 |
| | 300 | 80.24 | 77.05 | 14692 | 250 | 300 | 0.0135 | 0.0218 | −0.1730 |
| | 350 | 81 | 77.69 | 13202 | 300 | 350 | 0.0189 | 0.0166 | −0.2028 |
| | 400 | 80.6 | 77.17 | 11712 | 350 | 400 | −0.0099 | −0.0134 | −0.2257 |
| | 450 | 80.69 | 77.08 | 10200 | 400 | 450 | −0.0022 | −0.0023 | −0.2582 |
| | 500 | 80.16 | 75.8 | 8721 | 450 | 500 | −0.0131 | −0.0332 | −0.29 |
| | 550 | 79 | 74.6 | 7290 | 500 | 550 | −0.0289 | −0.0317 | −0.3282 |
| | 600 | 77.39 | 72.6 | 5916 | 550 | 600 | −0.0408 | −0.0536 | −0.3769 |
| | 650 | 75.5 | 70.6 | 4640 | 600 | 650 | −0.0488 | −0.0551 | −0.4314 |
| | 700 | 74 | 66.98 | 3526 | 650 | 700 | −0.0397 | −0.1025 | −0.4802 |
| | 750 | 70.2 | 62.6 | 2539 | 700 | 750 | −0.1027 | −0.1308 | −0.5598 |
| | 800 | 67.5 | 56.96 | 1643 | 750 | 800 | −0.0769 | −0.1802 | −0.7058 |

Embodiment 3

The Samarium-Cobalt based permanent magnet consisting essentially of elements Sm, Co, Fe, Cu, Zr, Gd, and Dy is made. Percentages of mass these elements of Sm is about 12.88%, Co is about 50.52%, Fe is about 13.78%, Cu is about 6.27%, Zr is about 2.81%, Gd is about 5.39%, and Dy is about 8.35%. HRE is the combination of Gd and Dy with percentage of mass of about 13.74%, Dy is also the element of R, and the percentage of mass of R is about 8.35%.

The Samarium-Cobalt based permanent magnet of embodiment 3 can be made by the same method of embodiment 1.

In embodiment 3, the microstructure of the Samarium-Cobalt based permanent magnet is a cellular structure composed of the $(SmHRER)(CoM)_5$ compound and the $(SmHRER)_2(CoM)_{17}$ compound. The $(SmHRER)(CoM)_5$ compound is a cell boundary phase, the $(SmHRER)_2(CoM)_{17}$ compound is an intracellular phase, the crystalline structure of the $(SmHRER)_2(CoM)_{17}$ compound is a rhombic structure, and the crystalline structure of the $(SmHRER)(CoM)_5$ compound is a hexagonal structure.

The alternating current magnetic susceptibility test and magnetic properties test are performed on the Samarium-Cobalt based permanent magnet obtained in embodiment 3. FIG. 2 shows the alternating current magnetic susceptibility test result. From FIG. 2, it can be seen that the spin reorientation transition temperature of the $(SmHRER)(CoM)_5$ compound of this sample is about 122K. FIG. 3 shows the relationship between the coercivity and the temperature. From FIG. 3, it can be seen that the coercivity increases as the temperature increases at the temperature interval of 100K to 200K, that is the Samarium-Cobalt based permanent magnet obtained in embodiment 3 has a positive temperature coefficient of coercivity at the temperature interval of 100K to 200K; the Samarium-Cobalt based permanent magnet obtained in embodiment 3 has the minimum temperature coefficient of coercivity at the temperature about 100K and has the maximum temperature coefficient of coercivity at the temperature about 200K, and the absolute value of the temperature coefficient of coercivity are very small and less than 0.01% per degree centigrade. FIG. 4 shows the relationship between the saturation magnetization intensity and the temperature. FIG. 5 shows the relationship between the remanence and the temperature. From FIGS. 4 and 5, it can be seen that the saturation magnetization intensity and the remanence have the same variation as the temperature increases, both the saturation magnetization intensity and the remanence increases first and then decreases as the temperature increases, and the remanence has very small variation as the temperature change at the temperature interval of 300K to 400K. The temperature interval where the absolute value of the temperature coefficient of remanence is less than 0.01% per degree centigrade is not completely overlapped with the temperature interval where the absolute value of the temperature coefficient of coercivity is less than 0.01% per degree centigrade. Table 3 shows the saturation magnetization intensity, the remanence, the coercivity of the Samarium-Cobalt based permanent magnet obtained in embodiment 3 at different temperatures. Table 3 also shows the temperature coefficient of saturation magnetization intensity, the temperature coefficient of remanence, and the temperature coefficient of coercivity of the Samarium-Cobalt based permanent magnet obtained in embodiment 3 at corresponding temperature intervals.

TABLE 3

| Number | T (K.) | Ms (emu/g) | Mr (emu/g) | Hcj (Oe) | Ti (K.) | | γ (%/° C.) | α (%/° C.) | β (%/° C.) |
|---|---|---|---|---|---|---|---|---|---|
| Embodiment 3 | 2 | 70.8 | 66.53 | 27392 | start | stop | | | |
| | 50 | 72.1 | 67.72 | 15774 | 2 | 50 | 0.0382 | 0.0373 | −0. 8836 |
| | 100 | 76.57 | 70.97 | 8967 | 50 | 100 | 0.1240 | 0.0960 | −0. 8631 |
| | 150 | 78.78 | 74.67 | 8984 | 100 | 150 | 0.0577 | 0.1043 | 0.0038 |
| | 200 | 80.62 | 76.22 | 10166 | 150 | 200 | 0.0467 | 0.0415 | 0.2631 |
| | 250 | 81.63 | 77.35 | 10521 | 200 | 250 | 0.0251 | 0.0297 | 0.0698 |
| | 300 | 82.3 | 77.89 | 10218 | 250 | 300 | 0.0164 | 0.0140 | −0.05760 |
| | 350 | 83.2 | 78.29 | 9552 | 300 | 350 | 0.0219 | 0.0103 | −0.1304 |
| | 400 | 82.2 | 77.45 | 8697 | 350 | 400 | −0.0240 | −0.0215 | −0.1790 |
| | 450 | 81.9 | 74.96 | 7924 | 400 | 450 | −0.0073 | −0.0643 | −0.1778 |
| | 500 | 81.5 | 73.5 | 6680 | 450 | 500 | −0.0098 | −0.0389 | −0.3140 |
| | 550 | 80.6 | 72.02 | 5461 | 500 | 550 | −0.0221 | −0.0403 | −0.3650 |
| | 600 | 79.87 | 70.2 | 4268 | 550 | 600 | −0.0181 | −0.0505 | −0.4369 |
| | 650 | 77.97 | 66.76 | 3218 | 600 | 650 | −0.0476 | −0.0980 | −0.4920 |
| | 700 | 76 | 62.11 | 2302 | 650 | 700 | −0.0505 | −0.1393 | −0.5693 |
| | 750 | 72 | 56.97 | 1569 | 700 | 750 | −0.1053 | −0.1655 | −0.6368 |
| | 800 | 68.4 | 49.2 | 959 | 750 | 800 | −0.1000 | −0.2728 | −0.7776 |

Embodiment 4

The Samarium-Cobalt based permanent magnet consisting essentially of elements Sm, Co, Fe, Cu, Zr, Gd, and Dy is made. Percentages of mass these elements of Sm is about 12.87%, Co is about 50.48%, Fe is about 13.76%, Cu is about 6.26%, Zr is about 2.81%, Gd is about 2.69%, and Dy is about 11.13%. HRE is the combination of Gd and Dy with percentage of mass about 13.82%, Dy is also the element of R, and the percentage of mass of R is about 11.13%.

The Samarium-Cobalt based permanent magnet of embodiment 4 can be made by the same method of embodiment 1.

Figure 1B:
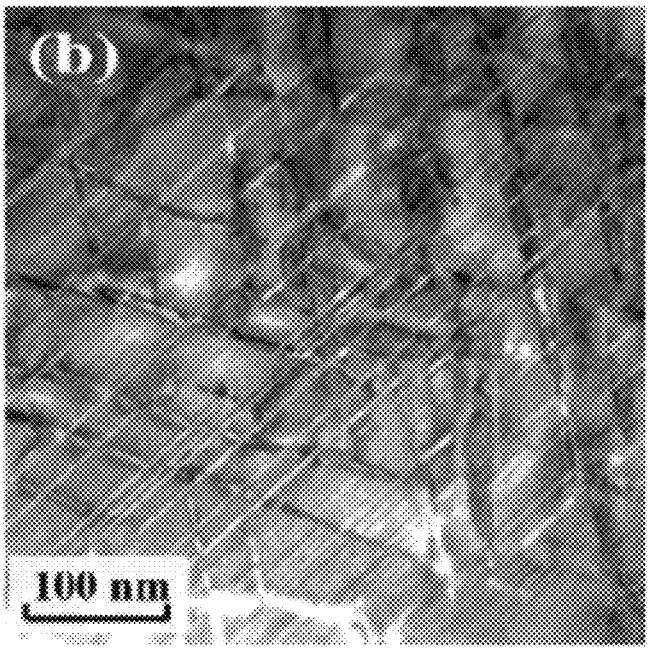
FIG. 1B shows a transmission electron microscope photo of the Samarium-Cobalt based permanent magnet obtained in embodiment 4 when the observation plane is parallel to the orientation axis.

In embodiment 4, the transmission electron microscope test is performed on the Samarium-Cobalt based permanent magnet. FIG. 1A shows a transmission electron microscope photo of the Samarium-Cobalt based permanent magnet when the observation plane is perpendicular to the orientation axis. FIG. 1B shows a transmission electron microscope photo of the Samarium-Cobalt based permanent magnet when the observation plane is parallel to the orientation axis. From FIGS. 1A-1B, it can be seen that the microstructure of the Samarium-Cobalt based permanent magnet is a cellular structure composed of the $(SmHRER)(CoM)_5$ compound and the $(SmHRER)_2(CoM)_{17}$ compound. The $(SmHRER)(CoM)_5$ compound is a cell boundary phase, the $(SmHRER)_2(CoM)_{17}$ compound is an intracellular phase, the crystalline structure of the $(SmHRER)_2(CoM)_{17}$ compound is a rhombic structure, the crystalline structure of the $(SmHRER)(CoM)_5$ compound is a hexagonal structure.

Figure 7:
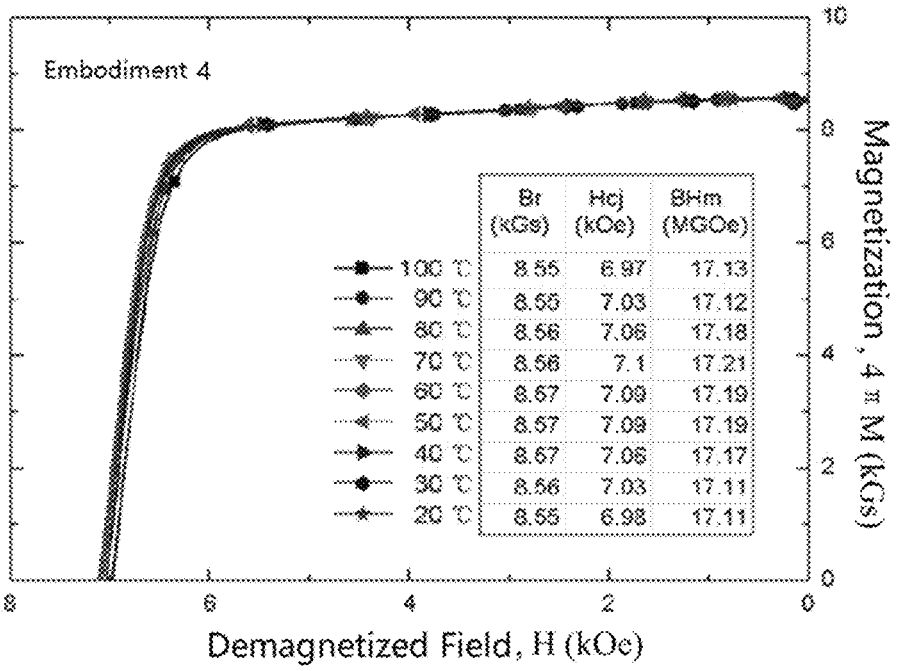
FIG. 7 shows a demagnetization curve from the room temperature to 100° C. of the Samarium-Cobalt based permanent magnet obtained in embodiment 4.

The alternating current magnetic susceptibility test and magnetic properties test are performed on the Samarium-Cobalt based permanent magnet obtained in embodiment 4. FIG. 2 shows the alternating current magnetic susceptibility test result. From FIG. 2, it can be seen that the spin reorientation transition temperature of the $(SmHRER)(CoM)_5$ compound of this sample is about 163K. FIG. 3 shows the relationship between the coercivity and the temperature. From FIG. 3, it can be seen that the coercivity increases as the temperature increases at the temperature interval of 100K to 350K, that is the Samarium-Cobalt based permanent magnet obtained in embodiment 4 has a positive temperature coefficient of coercivity at the temperature interval of 100K to 350K; the Samarium-Cobalt based permanent magnet obtained in embodiment 4 has the minimum temperature coefficient of coercivity at the temperature about 100K and has the maximum temperature coefficient of coercivity at the temperature about 350K, and the absolute value of the temperature coefficient of coercivity is very small and less than 0.01% per degree centigrade. FIG. 4 shows the relationship between the saturation magnetization intensity and the temperature. FIG. 5 shows the relationship between the remanence and the temperature. From FIGS. 4 and 5, it can be seen that the saturation magnetization intensity and the remanence have the same variation as the temperature increases, both the saturation magnetization intensity and the remanence increases first and then decreases as the temperature increases, and the remanence has very small variation as the temperature change at the temperature interval of 300K to 400K. At the temperature interval of 300K to 400K, the absolute value of the temperature coefficient of remanence is less than 0.01% per degree centigrade and the absolute value of the temperature coefficient of coercivity is also less than 0.01% per degree centigrade. FIG. 7 shows the demagnetization curve from the room temperature to 100° C. From FIG. 7, it can be seen that, at the temperature interval from the room temperature to 100° C., the absolute value of the temperature coefficient of remanence of the magnet is less than 0.01% per degree centigrade, and the absolute value of the temperature coefficient of coercivity of the magnet is also less than 0.01% per degree centigrade. Table 4 shows the saturation magnetization intensity, the remanence, the coercivity of the Samarium-Cobalt based permanent magnet obtained in embodiment 4 at different temperatures. Table 4 also shows the temperature coefficient of saturation magnetization intensity, the temperature coefficient of remanence, and the temperature coefficient of coercivity of the Samarium-Cobalt based permanent magnet obtained in embodiment 4 at corresponding temperature intervals.

TABLE 4

| Number | T (K) | Ms (emu/g) | Mr (emu/g) | Hcj (Oe) | Ti (K) | | γ (%/° C.) | α (%/° C.) | β (%/° C.) |
|---|---|---|---|---|---|---|---|---|---|
| Embodiment 4 | 2 | 69.13 | 64.14 | 21280 | start | stop | | | |
| | 50 | 70.33 | 65.1 | 11129 | 2 | 50 | 0.0361 | 0.0312 | −0.9938 |
| | 100 | 75.5 | 67.9 | 4788 | 50 | 100 | 0.1470 | 0.0860 | −1.1395 |
| | 150 | 79.96 | 71.69 | 3651 | 100 | 150 | 0.1181 | 0.1116 | −0.4749 |
| | 200 | 81.79 | 77.2 | 5243 | 150 | 200 | 0.0458 | 0.1537 | 0.8721 |
| | 250 | 83.82 | 79.2 | 7002 | 200 | 250 | 0.0496 | 0.0518 | 0.6709 |
| | 300 | 83.9 | 79.9 | 7863 | 250 | 300 | 0.0019 | 0.0176 | 0.2459 |
| | 350 | 83.7 | 79.78 | 7957 | 300 | 350 | −0.0048 | −0.0030 | 0.0239 |
| | 400 | 83.7 | 79.46 | 7621 | 350 | 400 | 0 | −0.0080 | −0.0844 |
| | 450 | 80.1 | 78.69 | 6844 | 400 | 450 | −0.0860 | −0.0194 | −0. 2039 |
| | 500 | 79.9 | 77.74 | 5982 | 450 | 500 | −0.0050 | −0.0241 | −0. 2519 |
| | 550 | 78.16 | 75.63 | 5004 | 500 | 550 | −0.0435 | −0.0543 | −0. 3269 |
| | 600 | 76.6 | 73.71 | 3995 | 550 | 600 | −0.0399 | −0.0508 | −0. 4033 |
| | 650 | 75.4 | 71.27 | 3036 | 600 | 650 | −0.0313 | −0.0662 | −0. 4801 |
| | 700 | 72.9 | 66.81 | 2212 | 650 | 700 | −0.0663 | −0.1252 | −0. 5428 |
| | 750 | 70.7 | 61.59 | 1514 | 700 | 750 | −0.0603 | −0.1562 | −0. 6311 |
| | 800 | 67.2 | 53.25 | 932 | 750 | 800 | −0.0990 | −0.2708 | −0. 7688 |

TABLE 5 components and percentages of the samples of embodiments 1-4

($TM = Co_{0.695}Fe_{0.2}Cu_{0.08Z\text{-}0.025}Zr_{0.025}$)

| Number | Components of the alloy | Mass percentage of each element in the alloy | | | | | | |
|---|---|---|---|---|---|---|---|---|
| | | Sm | Gd | Dy | Co | Fe | Cu | Zr |
| Embodiment 1 | $Sm_{0.5}Gd_{0.4}Dy_{0.1}TM_{7.2}$ | 12.90 | 10.79 | 2.79 | 50.61 | 13.80 | 6.28 | 2.82 |
| Embodiment 2 | $Sm_{0.5}Gd_{0.3}Dy_{0.2}TM_{7.2}$ | 12.89 | 8.09 | 5.57 | 50.57 | 13.79 | 6.28 | 2.82 |
| Embodiment 3 | $Sm_{0.5}Gd_{0.2}Dy_{0.3}TM_{7.2}$ | 12.88 | 5.39 | 8.35 | 50.52 | 13.78 | 6.27 | 2.81 |
| Embodiment 4 | $Sm_{0.5}Gd_{0.1}Dy_{0.4}TM_{7.2}$ | 12.87 | 2.69 | 11.13 | 50.48 | 13.76 | 6.26 | 2.81 |

TABLE 6

| Number | α (%/° C.) | β (%/° C.) |
|---|---|---|
| Embodiment 1 | −0.0014 | −0.2655 |
| Embodiment 4 | 0.0000 | 0.0018 |

From Table 6, it can be seen that at the temperature interval from the room temperature to 100° C., the absolute values of the temperature coefficient of remanence of the magnets of both embodiment 1 and embodiment 4 is less than 0.01% per degree centigrade, and the absolute value of the temperature coefficient of coercivity of the magnet of embodiment 4 is two orders of magnitude higher than the absolute value of the temperature coefficient of coercivity of the magnet of embodiment 1.

Embodiment 5

The $(Sm_{0.5}Gd_{0.5})Co_5$ permanent magnet material is used as the strong magnetic phase, the $DyCo_5$ is used as the magnetic phase with spin reorientation transition. The $(Sm_{0.5}Gd_{0.5})Co_5$ permanent magnet material film and the $DyCo_5$ film are made by magnetron sputtering, so that a multi-layer structure including a plurality of $(Sm_{0.5}Gd_{0.5})Co_5$ permanent magnet material films and a plurality of $DyCo_5$ films alternately stacked with each other layer by layer. Each of the $(Sm_{0.5}Gd_{0.5})Co_5$ permanent magnet material film and the $DyCo_5$ film has a thickness in a range from about 5 nanometers to about 800 nanometers. In the temperature interval of 350K to 400K, the permanent magnet material of embodiment 5 has an absolute value of temperature coefficient of remanence less than 0.01% per degree centigrade and an absolute value of temperature coefficient of coercivity less than 0.03% per degree centigrade.

Comparative Embodiment

The Samarium-Cobalt based permanent magnet consisting essentially of elements Sm, Co, Fe, Cu, Zr, and Nd is made. Percentages of mass these elements of Sm is about 13.06%, Co is about 51.23%, Fe is about 13.97%, Cu is about 6.36%, Zr is about 2.85%, and Nd is about 12.53%.

The Samarium-Cobalt based permanent magnet of comparative embodiment is made by following steps:

S100, providing a raw material including elements Sm, Co, Fe, Cu, Zr, and Nd in accordance with above percentages of mass;

S200, smelting the raw material in an induction smelting furnace to obtain an alloy ingot; then crushing the alloy ingot to form grains, and jet milling or ball milling the grains to obtain magnet powder;

S300, shaping the magnet powder obtained in step S200 under the protection of nitrogen gas and in magnetic field with an intensity of about 2 T to form a preform, and then cold isostatic pressing the preform for about 60 seconds under the pressure of about 200 Mpa to obtain a magnet body;

S400, sintering the magnet body obtained in step S300 in a vacuum sintering furnace with an air pressure below 4 mPa and under the protection of Argon gas.

In S400, the sintering the magnet body is performed by following: the vacuum sintering furnace is first heated to a temperature from 1200° C. to 1215° C. and kept at this temperature for about 30 minutes for sintering; the vacuum sintering furnace is cooled to a temperature from 1160° C. to 1190° C. and kept at this temperature for about 3 hours for solid solution; the vacuum sintering furnace is cooled to room temperature by air cooling or water cooling; the vacuum sintering furnace is heated to about 830° C. and isothermal aging for about 12 hours at this temperature; the vacuum sintering furnace is cooled to about 400° C. with a cooling speed of about 0.7° C./min and kept at this temperature for about 3 hours; and then the vacuum sintering furnace is rapidly cooled to room temperature, and Samarium-Cobalt based permanent magnet is obtained.

In the comparative embodiment, the microstructure of the Samarium-Cobalt based permanent magnet is a cellular structure composed of a $(SmR)(CoM)_5$ compound and a $(SmR)_2(CoM)_{17}$ compound. The $(SmR)(CoM)_5$ compound is a cell boundary phase, the $(SmR)_2(CoM)_{17}$ compound is an intracellular phase, the crystalline structure of the $(SmR)_2(CoM)_{17}$ compound is a rhombic structure, the crystalline structure of the $(SmR)(CoM)_5$ compound is a hexagonal structure, and the Cu element concentrates in the $(SmR)(CoM)_5$ compound of cell boundary phase.

Figure 8:
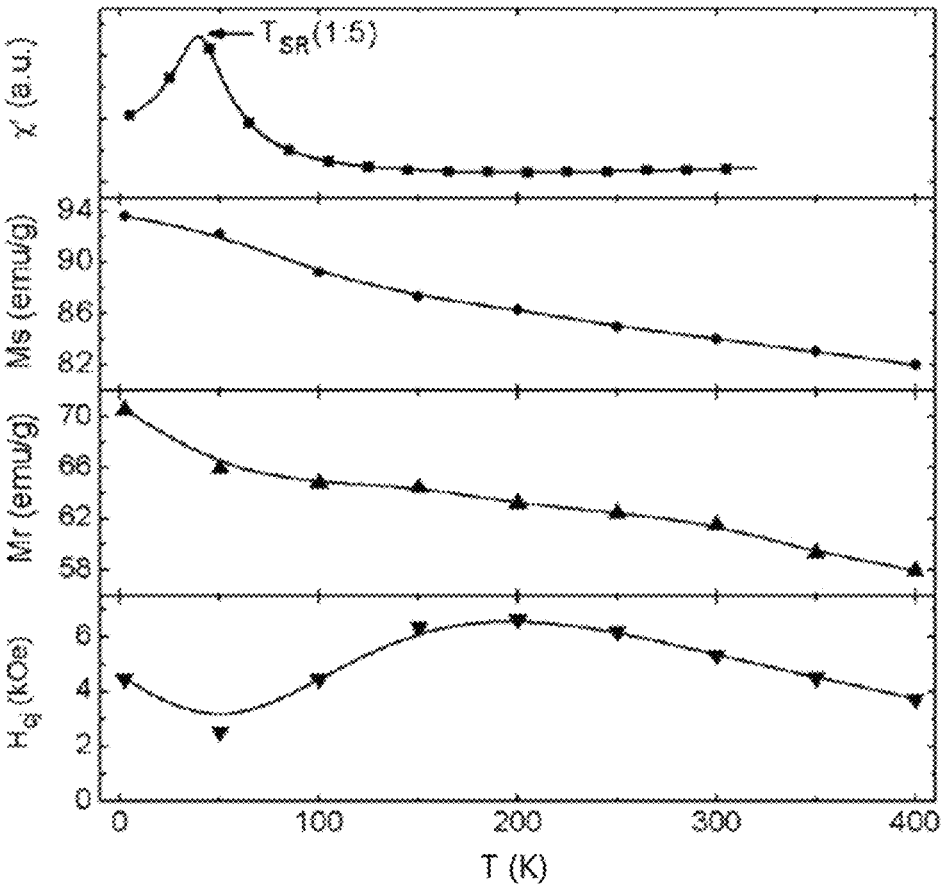
FIG. 8 shows the alternating current magnetic susceptibility test result, the relationship between the coercivity and the temperature, the relationship between the saturation magnetization intensity and the temperature, and the relationship between the remanence and the temperature of the Samarium-Cobalt based permanent magnet obtained in comparative embodiment.

The alternating current magnetic susceptibility test and magnetic properties test are performed on the Samarium-Cobalt based permanent magnet obtained in the comparative embodiment. FIG. 8 shows the alternating current magnetic susceptibility test result, the relationship between the coercivity and the temperature, the relationship between the saturation magnetization intensity and the temperature, and the relationship between the remanence and the temperature. From FIG. 8, it can be seen that the spin reorientation transition temperature of the $(SmR)(CoM)_5$ compound of this sample is about 39K; the saturation magnetization intensity and the remanence have the same variation as the temperature increases, and both the saturation magnetization intensity and the remanence decreases as the temperature increases; both the temperature coefficient of saturation magnetization intensity and the temperature coefficient of remanence is approximately −0.03% per degree centigrade to 0.05% per degree centigrade; at the temperature interval of 50K to 200K, the coercivity increases as the temperature increases, that is a positive temperature coefficient of coercivity is obtained; the Samarium-Cobalt based permanent magnet obtained in comparative embodiment has the minimum temperature coefficient of coercivity at the temperatures about 50K and has the maximum temperature coefficient of coercivity at the temperatures about 200K, and the absolute value of the temperature coefficient of coercivity is very small and less than 0.01% per degree centigrade.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A permanent magnet material, comprising a permanent magnet having a microstructure, wherein the microstructure comprises: a first magnetic phase and a second magnetic phase; the first magnetic phase is a magnetic phase with uniaxial anisotropy, and the second magnetic phase is a magnetic phase with spin reorientation transition; the first magnetic phase and the second magnetic phase are isolated from each other; the first magnetic phase is a SmCo compound, Sm is partially replaced by HRE or by a combination of HRE and R different from HRE; the second magnetic phase is a $RCo_5$ compound, or a $R_2Co_{17}$ compound; HRE is one of Gd, Tb, Dy, Ho, Er, Tm, Yb, Lu, and a combination thereof; R is one of Pr, Nd, and a combination thereof; and a first absolute value of a temperature coefficient of saturation magnetization intensity of the first magnetic phase is less than 0.02%/° C.

2. The permanent magnet material of claim 1, wherein a size of the microstructure in at least one dimension is in a range from about 5 nanometers to about 800 nanometers.

3. The permanent magnet material of claim 1, wherein the first magnetic phase and the second magnetic phase are isolated from each other by encapsulation, interlayer, or both encapsulation and interlayer.

4. The permanent magnet material of claim 1, wherein an easy magnetization direction of the second magnetic phase has a convention from easy plane to easy axis as temperature increases.

5. The permanent magnet material of claim 1, wherein in a temperature range from 2K to 600K, a second absolute value of a temperature coefficient of coercivity of the permanent magnet is less than 0.03% per degree centigrade, and a third absolute value of a temperature coefficient of remanence of the permanent magnet is less than 0.02% per degree centigrade.

6. The permanent magnet material of claim 1, wherein a percentage of mass of R is from 8% to 20%, and a percentage of mass of HRE is from 8% to 18%.

7. A device comprising a permanent magnet material comprising a permanent magnet, the permanent magnet having a microstructure, wherein the microstructure comprises: a first magnetic phase and a second magnetic phase; the first magnetic phase is a magnetic phase with uniaxial anisotropy, and the second magnetic phase is a magnetic phase with spin reorientation transition; the first magnetic phase and the second magnetic phase are isolated from each other; the first magnetic phase is a SmCo compound, Sm is partially replaced by HRE or by a combination of HRE and R different from HRE; the second magnetic phase is a $RCo_5$ compound, or a $R_2Co_{17}$ compound; HRE is one of Gd, Tb, Dy, Ho, Er, Tm, Yb, Lu, and a combination thereof; R is one of Pr, Nd, and a combination thereof; and a first absolute value of a temperature coefficient of saturation magnetization intensity of the first magnetic phase is less than 0.02%/° C., in a temperature range from 2K to 600K, a third absolute value of a temperature coefficient of remanence of the permanent magnet is less than 0.02% per degree centigrade.

8. The device of claim 7, wherein a size of the microstructure in at least one dimension is in a range from about 5 nanometers to about 800 nanometers.

9. The device of claim 7, wherein the first magnetic phase and the second magnetic phase are isolated from each other by encapsulation, interlayer, or both encapsulation and interlayer.

10. The device of claim 7, wherein an easy magnetization direction of the second magnetic phase has a convention from easy plane to easy axis as temperature increases.

11. The device of claim 7, wherein in a temperature range from 2K to 600K, a second absolute value of a temperature coefficient of coercivity of the permanent magnet is less than 0.03% per degree centigrade, and a third absolute value of a temperature coefficient of remanence of the permanent magnet is less than 0.02% per degree centigrade.

* * * * *